US007791575B2

(12) United States Patent
Lau et al.

(10) Patent No.: US 7,791,575 B2
(45) Date of Patent: Sep. 7, 2010

(54) CIRCUIT FOR DRIVING DISPLAY PANEL WITH TRANSITION CONTROL

(75) Inventors: Yuen Pat Lau, North Point (HK); Wai Hon Ng, Cho Yiu Estate (HK); Stephen Wai-Yan Lai, Kowloon (HK)

(73) Assignee: Solomon Systech Limited, New Territories (HK)

( * ) Notice: Subject to any disclaimer, the term of this patent is extended or adjusted under 35 U.S.C. 154(b) by 967 days.

(21) Appl. No.: 11/181,913

(22) Filed: Jul. 15, 2005

(65) Prior Publication Data

US 2007/0013632 A1 Jan. 18, 2007

(51) Int. Cl.
*G09G 3/36* (2006.01)

(52) U.S. Cl. ..... 345/89; 345/98; 345/690

(58) Field of Classification Search ..... 345/87–102, 345/690; 326/15, 27, 30, 83, 87; 327/170
See application file for complete search history.

(56) References Cited

U.S. PATENT DOCUMENTS 4,797,579 A 1/1989 Lewis
6,097,219 A * 8/2000 Urata et al. ..... 326/83
6,300,930 B1 * 10/2001 Mori ..... 345/94
6,304,239 B1 * 10/2001 McKnight ..... 345/87
6,417,708 B1 7/2002 Fiedler
6,671,081 B2 12/2003 Kawai
6,781,535 B2 * 8/2004 Lee ..... 341/144
7,158,108 B2 * 1/2007 Hagino ..... 345/89
2004/0100433 A1 * 5/2004 Ham ..... 345/89
2006/0125715 A1 * 6/2006 Choi ..... 345/14

* cited by examiner

*Primary Examiner*—Alexander Eisen
*Assistant Examiner*—Kenneth B Lee, Jr.
(74) *Attorney, Agent, or Firm*—Finnegan, Henderson, Farabow, Garrett & Dunner, LLP

(57) ABSTRACT

A driving circuit for driving a display panel including a plurality of pixels. The driving circuit includes a selecting signal generator to generate a plurality of selecting signals according to a first and a second pixel data, a voltage divider to provide a plurality of sub-transition voltages, and a voltage selector coupled to receive the plurality of sub-transition voltages and the selecting signal, and to selectively output a plurality of sub-transition voltages serially according to the selecting signals. A drive buffer is coupled to receive the outputted sub-transition voltages serially and to serially generate a plurality of sub-transition driving voltages according to the outputted sub-transition voltages during a transition time period.

12 Claims, 6 Drawing Sheets

CIRCUIT FOR DRIVING DISPLAY PANEL WITH TRANSITION CONTROL

FIELD OF THE INVENTION

The present invention generally relates to a circuit for driving a display panel and, more particularly, to a circuit for driving a display panel with transition control.

BACKGROUND OF THE INVENTION

A display panel, such as a liquid crystal display (LCD), includes pixels arranged in rows and columns. Each pixel has its own electrode for receiving a driving voltage. The voltage level of the driving voltage corresponds to the brightness of the pixel. More particularly, the amount of light passing through or reflected by each pixel is controlled by the level of these driving voltages.

A display panel further includes a driving circuit to receive pixel data corresponding to the brightness of the pixels of the display panel, generate driving voltages according to pixel data, and provide driving voltages to each of the pixels. When a display panel displays video images, the pixel data of different video images may be different. In this condition, the brightness of the pixels is controlled by the driving circuit by changing levels of the driving voltage applied to the pixels. There is a transition time period for the driving circuit to change levels of the driving voltage. The transition time period is between the time periods to display two successive video images, e.g., a previous video image and a current video image. In many applications, the driving circuit is required to change levels of the driving voltage in a very short time. In this condition, the transition time period can be much shorter than the time period to display each of the video images. The shorter the transition time period, the faster the transition rate of the display panel is and the better the display quality of the display panel will be.

However, for some types of display panels, such as electrophoretic displays (EPD), the transition time period required by their driving circuits to change levels of the driving voltage can be longer than that required by driving circuits used in liquid crystal displays. In addition to longer transition time period, the driving circuit used by an electrophoretic display must control the length of the transition time period and the levels of the driving voltages more accurately than the driving circuit used by a liquid crystal display during the transition period. The display quality of a conventional driving circuit used by an electrophoretic display will be degraded if the transitional conditions are not well-controlled. Therefore, conventional driving circuits used with liquid crystal displays are not suitable for use with electrophoretic displays since they cannot control the length of the transition time period and the levels of the driving voltages during the transition time period as accurately as required by electrophoretic displays. Examples of conventional driving circuits are described below.

One example of a conventional driving circuit is shown in FIG. 1 of U.S. Pat. No. 6,097,219 entitled "OUTPUT BUFFER WITH ADJUSTABLE DRIVING CAPABILITY" of Urata et al., which is reproduced as FIG. 1 herein. With reference to FIG. 1, the length of a transition time period required by a driving circuit 100 to change levels of driving signals is determined by the number of buffer circuits, i.e., B0, B1, B2, and B3 which are turned ON in response to each of bit signals b1~b10. The greater the number of buffer circuits turned ON in response to each of bit signals b1~b10, the shorter the transition time period that is required by driving circuit 100. Driving circuit 100 does not control the levels of the driving voltages during the transition time period.

Another example of a conventional driving circuit is shown in FIG. 1 of U.S. Pat. No. 4,797,579 entitled "CMOS VLSI DRIVER WITH CONTROLLED RISE AND FALL TIME" of Lewis, which is reproduced as FIG. 2 herein. With reference to FIG. 2, the length of a transition time period required by a driving circuit 200 is determined by $V_P(t)$ and $V_N(t)$ provided by voltage generators 210 and 220, respectively, and the levels of driving voltages during the transition time period are determined by capacitance of an output capacitor Co. However, the length of the transition time period and the levels of the driving voltages during the transition time period are limited by the characteristics of a PMOS $Q_{PO}$, an NMOS $Q_{No}$, and an output capacitor (Co) of driving circuit 200.

In addition to a voltage-driven driving circuit such as the conventional driving circuits shown in FIGS. 1 and 2, in some specific circumstances, a current-driven driving circuit, instead of a voltage-driven driving circuit, may be more suitable to drive a display panel. One example of a conventional current-driven driving circuit is shown in FIG. 1 of U.S. Pat. No. 6,417,708 entitled "RESISTIVE-LOADED CURRENT-MODE OUTPUT BUFFER WITH SLEW RATE CONTROL" of Fiedler, which is reproduced as FIG. 3 herein. With reference to FIG. 3, the length of a transition time period required by a driving circuit 300 is determined by the currents provided by two adjustable controlled current sources 310 and 320. Since driving circuit 300 is a current-driven driving circuit, it does not control the levels of driving voltages during the transition time period.

For conventional driving circuits shown in FIGS. 1, 2, and 3, although they appear to control the transition time period, the levels of driving voltages, or the levels of driving currents during transition, their control capabilities are sensitive to various factors such as voltage levels of driving voltages, current levels of driving currents, operating temperature, manufacturing variations, etc. As a result, such conventional driving circuits may not accurately control both the length of the transition time period and the voltage levels of the driving voltage when changing driving voltages from one voltage level to another during transition.

There is thus a general need in the art for a circuit with improved transition control for driving a display panel that overcomes one or more of the deficiencies of conventional driving circuits.

SUMMARY OF THE INVENTION

Accordingly, the present invention is directed to a circuit for driving a display panel that obviates one or more of the problems due to limitations and disadvantages of the related art.

In accordance with the present invention, there is provided a driving circuit for driving a display panel including a plurality of pixels. The driving circuit comprises a selecting signal generator to generate a plurality of selecting signals according to a first and a second pixel data, a voltage divider to provide a plurality of sub-transition voltages, a voltage selector coupled to receive the plurality of sub-transition voltages and the selecting signal, and to selectively output a plurality of sub-transition voltages serially according to the selecting signals, and a drive buffer coupled to receive the outputted sub-transition voltages serially and to serially generate a plurality of sub-transition driving voltages according to the outputted sub-transition voltages during a transition time period. Wherein each of the sub-transition driving voltages is sufficient to drive an output load during the transition time period.

Also, in accordance with the present invention, there is provided a method for driving a display panel including a plurality of pixels. The method comprises receiving a first and a second pixel data, generating a plurality of selecting signals serially according to the first and second pixel data, generating a plurality of sub-transition voltages, outputting one of the plurality of sub-transition voltages in response to each of the serially generated selecting signals, and generating a plurality of sub-transition driving voltages serially according to the plurality of outputted sub-transition voltages. Wherein each of the sub-transition driving voltages is sufficient to drive an output load so that the sub-transition driving voltages are serially generated in response to the serially generated plurality of selecting signals.

Additional features and advantages of the invention will be set forth in part in the description which follows, and in part will be obvious from the description, or may be learned by practice of the invention. The features and advantages of the invention will be realized and attained by means of the elements and combinations particularly pointed out in the appended claims.

It is to be understood that both the foregoing general description and the following detailed description are exemplary and explanatory only and are not restrictive of the invention, as claimed.

The accompanying drawings, which are incorporated in and constitute a part of this specification, illustrate several embodiments of the invention and, together with the description, serve to explain the principles of the invention.

DESCRIPTION OF THE EMBODIMENTS

Reference will now be made in detail to embodiments of the invention, which are illustrated in the accompanying drawings. Wherever possible, the same reference numbers will be used throughout the drawings to refer to the same or like parts.

Figure 1:
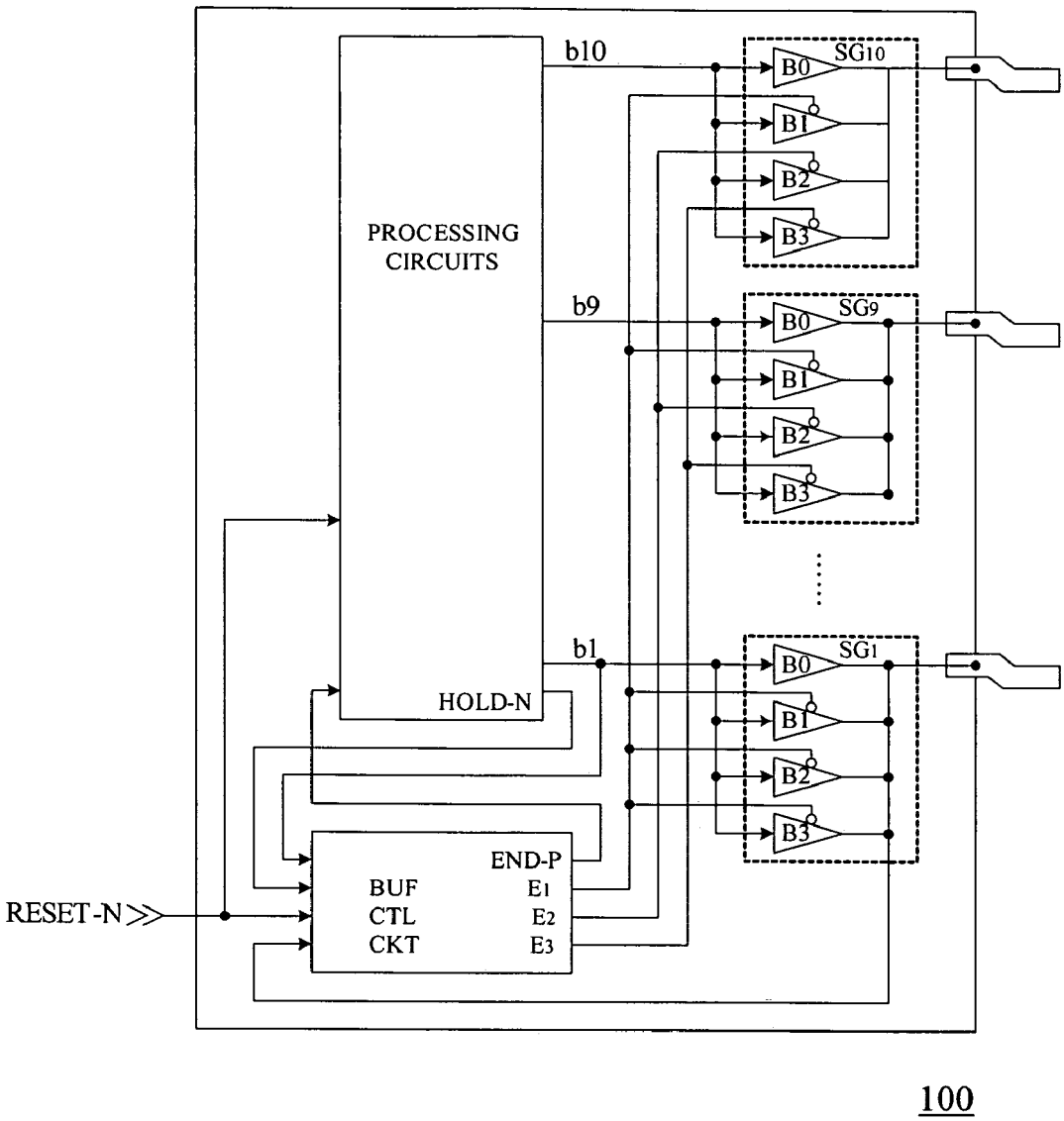
Fig. 1 (Prior Art)
FIG. 1 is a diagram illustrating an example of a conventional driving circuit.
Figure 2:
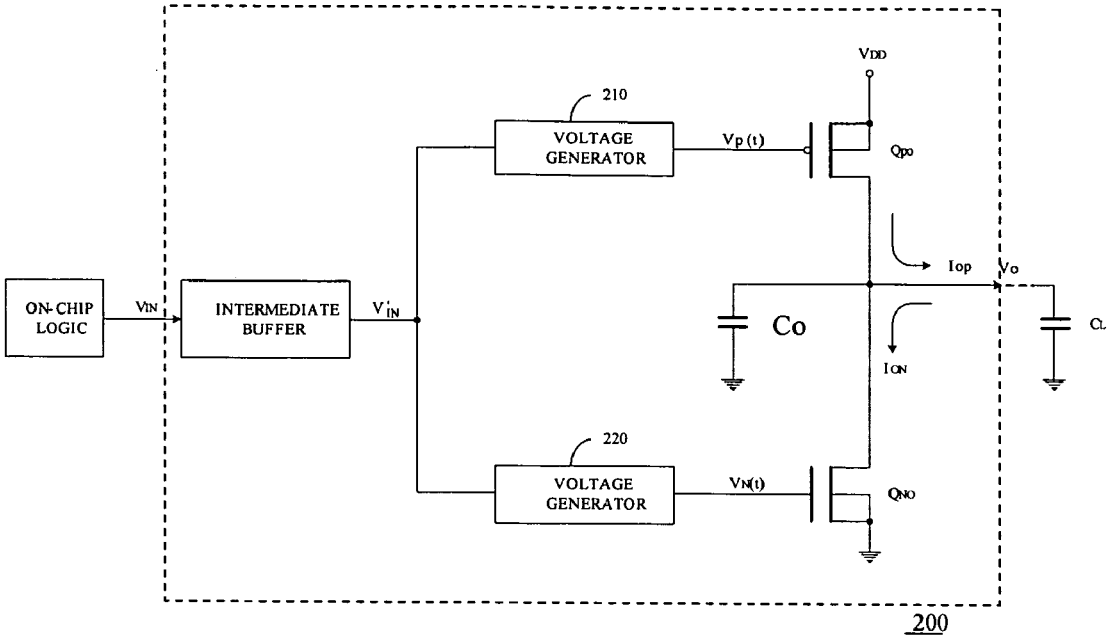
Fig. 2 (Prior Art)
FIG. 2 is a diagram illustrating another example of a conventional driving circuit.
Figure 3:
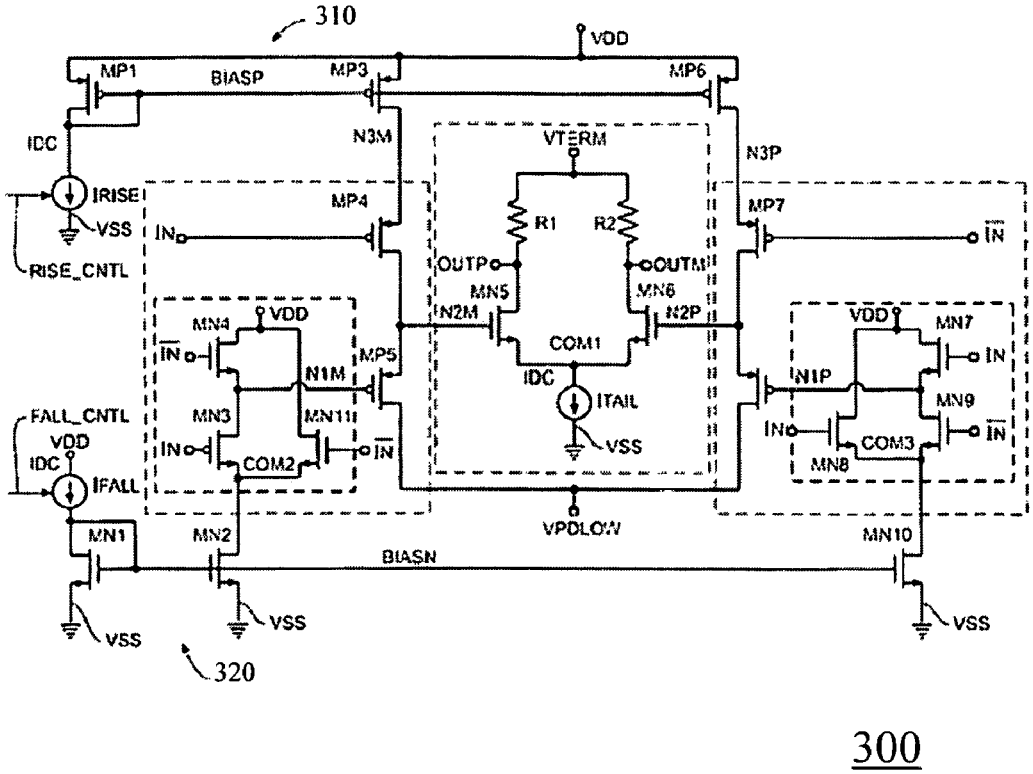
Fig. 3 (Prior Art)
FIG. 3 is a diagram illustrating still another example of a conventional driving circuit.
Figure 4:
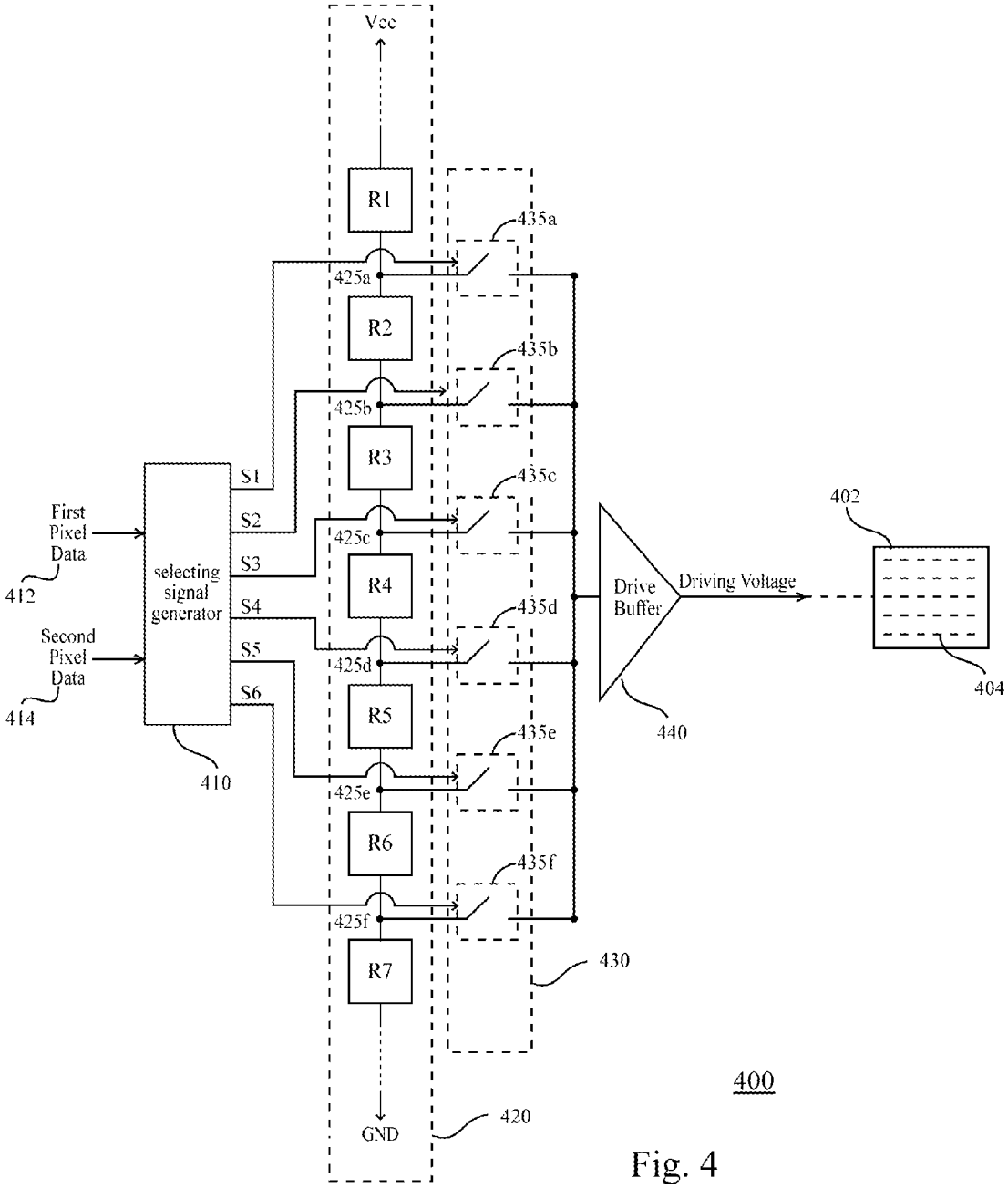
FIG. 4 is a diagram illustrating a circuit for driving a panel display according to an embodiment of the present invention.

FIG. 4 illustrates a driving circuit 400 with transition control for driving a display panel 402 which includes a plurality of pixels 404 according to an embodiment of the present invention. Driving circuit 400 includes a selecting signal generator 410, connectable to receive pixel data of different video images and to generate a plurality of selecting signals S1~S6 according to the pixel data during a transition time period. The value of pixel data of each video image corresponds to the brightness of the pixels of display panel 402 when display panel 402 displays the video image. When a display panel (e.g., display panel 402) displays a plurality of video images, the pixel data of successive video images, e.g., a previous video image and a current video image, are different. Selecting signal generator 410 generates selecting signals S1~S6 according to first pixel data 412 (voltage level Va) of the previous video image to enable display of that image and second pixel data 414 (voltage level Vb) of the current video image to enable display of that image and also provides selecting signals S1~S6 during the transition time period. Selecting signals S1~S6 are generated and provided serially. The transition time period is the time period between a time period to display two successive images, e.g., between a time period to display the previous video image and a time period to display the current video image.

Moreover, the transition time period can be long or short in time depending on a video image type (e.g., a still picture or a movie). Usually, pixel data have a resolution of several bits. The driving circuit is required to output the number of voltage levels according to the number of resolution bits. In particular, some panels (e.g. electrophoretic displays) will require several specific sub-transition levels in the transitioning between the first and second output voltage levels of Va and Vb. The preprogrammed sub-transition levels have many bits. There can be a number of such preprogrammed sub-levels transition schemes, e.g., 4 schemes as in signal generator 410, from voltage level Va of the first pixel data 412 to voltage level Vb of the second pixel data 414. The system design advantage of this generic select signal generator 410 is that it supports preprogrammed sub-transition levels and transition time period.

Driving circuit 400 also includes a voltage divider 420 to provide plural sub-transition voltages during the transition time period and a voltage selector 430 to receive selecting signals S1~S6 and output the plural sub-transition voltages according to selecting signals S1~S6 during the transition time period. Voltage selector 430 receives selecting signals S1~S6 serially and outputs the sub-transition voltages serially. A drive buffer 440 is coupled to receive the selected sub-transition voltages and provide output driving voltages corresponding to the selected sub-transition voltages. Drive buffer 440 receives the selected sub-transition voltages serially and provides output driving voltages corresponding to the selected sub-transition voltages serially. Each of the output driving voltages is sufficient to drive an output load, e.g., the pixels, during the transition time period.

In this embodiment, the pixel data of each successive image, e.g., current pixel data of a current image to be displayed and previous pixel data of an image displayed immediately prior to the current image, as well as selecting signals S1~S6, are all digital signals. Selecting signal generator 410 is a digital controller to receive, process, and generate digital signals. Voltage divider 420 includes a string of serial-connected resistors R1~R7 with one end of the string coupled to Vcc and the other end of the string coupled to a voltage reference, e.g., ground (GND). Voltage divider 420 further includes nodes 425*a*~425*f* each located between two of resistors R1~R7. Thus, the voltage of each of nodes 425*a*~425*f* is different. Voltage selector 430 includes switches 435*a*~435*f* respectively coupled to nodes 425*a*~425*f* and respectively controlled by selecting signals S1~S6. During operation, only one of switches 435*a*~435*f* is turned ON, i.e., closed, while the remaining ones of switches 435*a*~435*f* are turned OFF, i.e., open. In this condition, only one of nodes 425*a*~425*f* is coupled to drive buffer 440 to provide its node voltage to drive buffer 440. Drive buffer 440 is an operational amplifier to receive the node voltage of the coupled node and to provide an output driving voltage based on the received sub-transition voltage. The output driving voltage is sufficient to drive an output load, i.e., the pixels, during the transition time period. The voltage level of the output driving voltage corresponds to that of the received node voltage. In this embodiment, the voltage level of the output driving voltage is equal to that of the received node voltage.

Voltage divider 420 includes nodes 425*a*~425*f* for generating respective node voltages with different voltage levels to drive buffer 440. The level of each node voltage generated by voltage divider 420 is in between the voltages corresponding to a previous pixel data of a previous video image and a current pixel data of a current video image. For example, if selecting signal generator 410 receives previous pixel data for a particular pixel with a value corresponding to the voltage of node 425*a*, selecting signal generator 410 generates selecting signal S1 to voltage selector 430 to turn ON switch 435*a* so that node 425*a* is coupled to drive buffer 440. In this condition, drive buffer 440 outputs a driving voltage with a first voltage level, e.g., Va, equal or corresponding to the node voltage of node 425*a*. The first voltage level (Va) is sufficient to drive an output load, i.e., one of the pixels during the time period to display the previous video image. Then, if the value of the current pixel data received by selecting signal generator 410 for the particular pixel corresponds to the voltage of node 425*f*, selecting signal generator 410 will generate selecting signals S1, S2, S3, S4, S5, S6, one at a time serially, to turn ON the corresponding switches 435*a*, 435*b*, 435*c*, 435*d*, 435*e* and 435*f* one at a time to couple the corresponding nodes 425*a*, 425*b*, 425*c*, 425*d*, 425*e* and 425*f* one at a time to drive buffer 440. In this condition, drive buffer 440 outputs driving voltages from a first voltage level, e.g., Va, through a series of sub-transition voltages Vt1 (425*b*), Vt2 (425*c*), Vt3 (425*d*), Vt4 (425*e*), and settles with a second voltage level, e.g., Vb, which is equal to the node voltage of node 425*f*. Each of the sub-transition voltages Vt1 (425*b*), Vt2 (425*c*), Vt3 (425*d*), and Vt4 (425*e*) is sufficient to drive an output load, i.e., one of the pixels, during first, second, third, and fourth sub-transition time periods, respectively.

Figure 5:
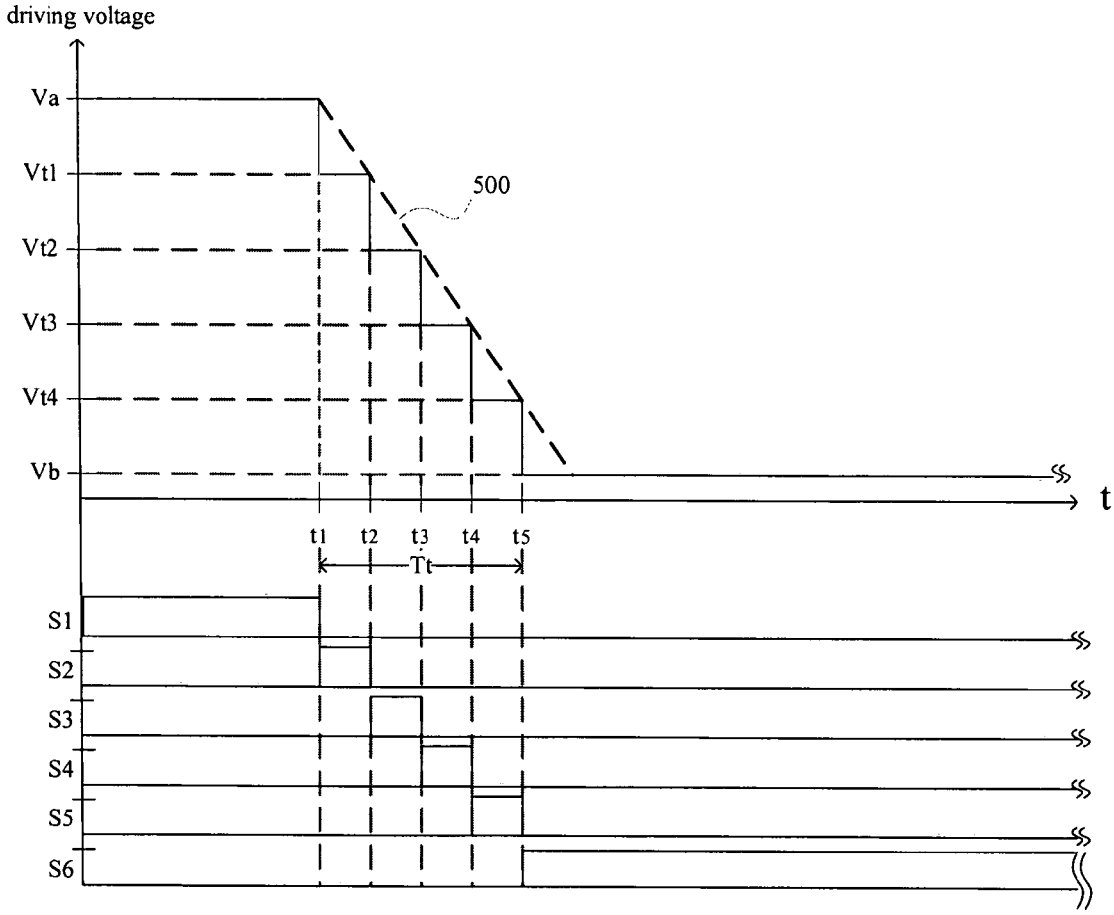
FIG. 5 is a diagram illustrating a timing chart of a driving voltage outputted from the driving circuit shown in FIG. 4 and corresponding selecting signals according to an embodiment of the present invention.

FIG. 5 is a diagram illustrating a timing chart of transitional driving voltages outputted from driving circuit 400 and the relationship of the sub-transition driving voltages to selecting signals S1~S6, according to an embodiment of the present invention. When the driving voltage is required to be changed from a first voltage level, e.g., Va, to a second voltage level, e.g., Vb, during a transition time period Tt, driving circuit 400 is required to provide four sub-transition voltages, e.g., Vt1, Vt2, Vt3, and Vt4, for four equal sub-transition time periods, e.g., t1~t2, t2~t3, t3~t4, and t4~t5, respectively, to produce a quasi-linear level change during transition. To achieve this, selecting signal generator 410 generates different selecting signals S1~S6 during the different sub-transition time periods sequentially. Only one of selecting signals S1~S6 is generated during each sub-transition period. Before transition, selecting signal generator 410 generates selecting signal S1 to turn ON switch 435*a* so that node 425*a* with node voltage Va is coupled to drive buffer 440. Drive buffer 440 outputs driving voltage Va which is sufficient to drive an output load, i.e., one of the pixels during a time period to display a previous video image.

When it is time to begin the transition from Va to Vb, selecting signal generator 410 generates selecting signal S2 during a first sub-transition time period t1~t2, to turn ON switch 435*b* instead of switch 435*a* so that node 425*b* with node voltage Vt1, which is smaller than Va, is coupled to drive buffer 440. Since only one selecting signal is generated during each sub-transition period, when selecting signal S2 is generated, selecting signal S1 is not generated. As a result, switch 435*a* is turned OFF. In this condition, drive buffer 440 outputs driving voltage Vt1 which is sufficient to drive an output load, i.e., one of the pixels, during the first sub-transition time period. During a second sub-transition time period t2~t3, selecting signal generator 410 generates selecting signal S3 to turn ON switch 435*c* so that node 425*c* with node voltage Vt2, which is smaller than Vt1, is coupled to drive buffer 440. As a result, drive buffer 440 outputs driving voltage Vt2 which is sufficient to drive an output load, i.e., one of the pixels, during the second sub-transition time period. During a third sub-transition time period t3~t4, selecting signal generator 410 generates selecting signal S4 to turn ON switch 435*d* so that node 425*d* with node voltage Vt3, which is smaller than Vt2, is coupled to drive buffer 440. As a result, drive buffer 440 outputs driving voltage Vt3 which is sufficient to drive an output load, i.e., one of the pixels, during the third sub-transition time period. During a fourth sub-transition time period t4~t5, selecting signal generator 410 generates selecting signal S5 to turn ON switch 435*e* so that node 425*e* with node voltage Vt4, which is smaller than Vt3, is coupled to drive buffer 440. As a result, drive buffer 440 outputs driving voltage Vt4 which is sufficient to drive an output load, i.e., one of the pixels, during the fourth time period. After the fourth sub-transition time period, selecting signal generator 410 generates selecting signal S6 to turn ON switch 435*f* so that node 425*f* with node voltage Vb, which is smaller than Vt4, is coupled to drive buffer 440. As a result, drive buffer 440 outputs driving voltage Vb which is sufficient to drive an output load, i.e., one of the pixels, during a time period to display the current video image. In this manner, driving circuit 400 can control the voltage level of driving voltages during transition and the time period of each sub-transition time period. In this embodiment, the driving voltage is changed from Va to Vb with a quasi-linear level change, which is indicated by a dotted line 500, during transition.

Figure 6:
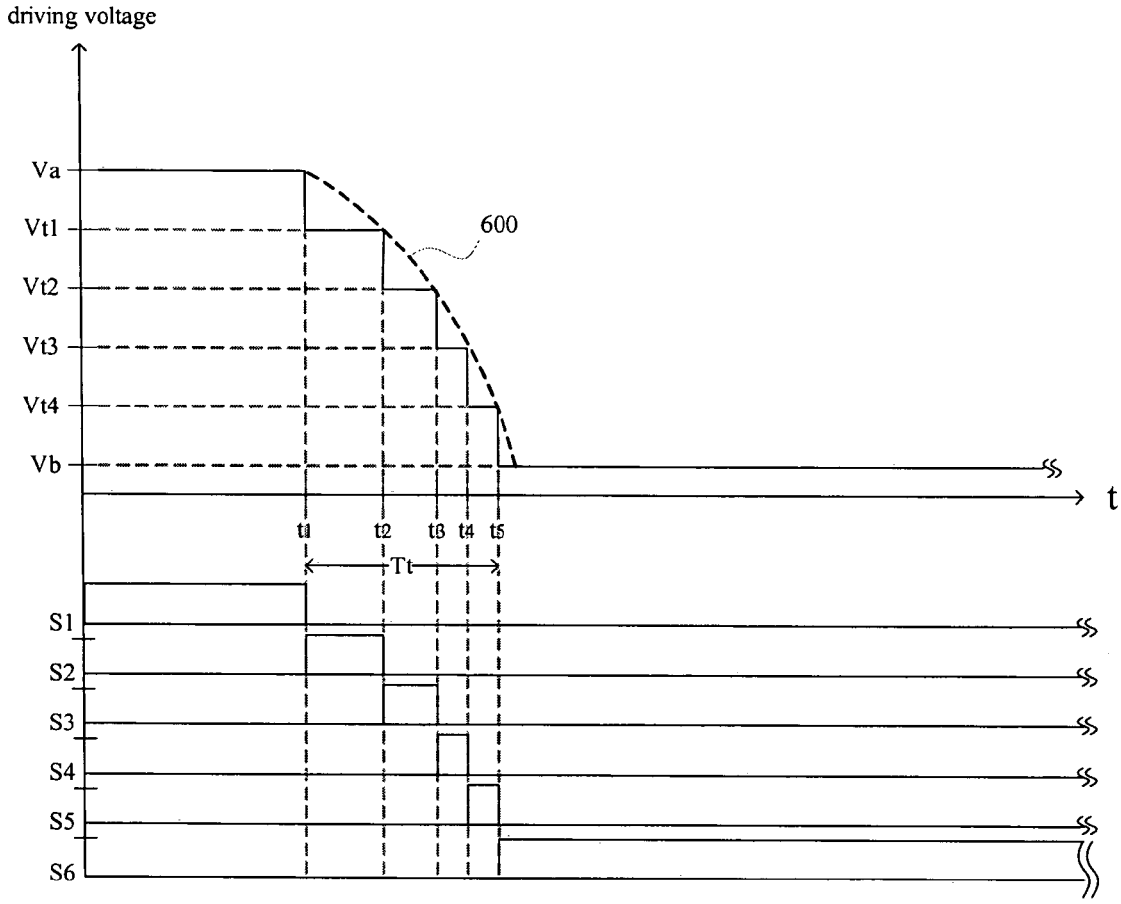
FIG. 6 is a diagram illustrating another timing chart of a driving voltage outputted from the driving circuit shown in FIG. 4 and corresponding selecting signals according to another embodiment of the present invention.

FIG. 6 is a diagram illustrating a timing chart of transitional driving voltages outputted from driving circuit 400 and the relationship of the transitional driving voltages to selecting signals S1~S6, according to another embodiment of the present invention. In addition to the quasi-linear level change during transition described with reference to FIG. 5, other transitional voltage level change characteristics can be produced by predetermining the number of sub-transition voltages, the voltage level of each sub-transition voltage, and/or the time period of each sub-transition time period, to meet specific requirements. For example, with reference to FIG. 6, the driving voltage is to be changed from a voltage level, e.g., Va, to another voltage level, e.g., Vb, during a transition time period Tt and is desired to produce a transitional voltage characteristic that follows a quasi-convex curve during transition. To meet these criteria, driving circuit 400 provides four sub-transition voltages, e.g., Vt1, Vt2, Vt3, and Vt4, for four sub-transition time periods that are unequal, e.g., t1~t2, t2~t3, t3~t4, and t4~t5, respectively. To achieve this, selecting signal generator 410 generates different selecting signals S1~S6 during the different sub-transition time periods. Before transition, selecting signal generator 410 generates selecting signal S1 to turn ON switch 435*a* so that node 425*a* with node voltage Va is coupled to drive buffer 440. As a result, drive buffer 440 outputs driving voltage Va which is sufficient to drive an output load, i.e., one of the pixels, during a time period to display a previous video image.

When it is desired to begin the transition from Va to Vb, selecting signal generator 410 generates selecting signal S2 during a first sub-transition time period t1~t2, to turn ON switch 435*b* so that node 425*b* with node voltage Vt1, which is smaller than Va, is coupled to drive buffer 440. As a result, drive buffer 440 outputs driving voltage Vt1 which is sufficient to drive an output load, i.e., one of the pixels, during the first sub-transition time period. During a second sub-transition time period t2~t3, which is shorter than first sub-transition time period t1~t2, selecting signal generator 410 generates selecting signal S3 to turn ON switch 435*c* so that node 425*c* with node voltage Vt2, which is smaller than Vt1, is coupled to drive buffer 440. As a result, drive buffer 440 outputs driving voltage Vt2 which is sufficient to drive an output load, i.e., one of the pixels, during the second sub-transition time period. During a third sub-transition time period t3~t4, which is shorter than second sub-transition time period t2~t3, selecting signal generator 410 generates selecting signal S4 to turn ON switch 435*d* so that node 425*d* with node voltage Vt3, which is smaller than Vt2, is coupled to drive buffer 440. As a result, drive buffer 440 outputs driving voltage Vt3 which is sufficient to drive an output load, i.e., one of the pixels, during the third sub-transition time period. During a fourth sub-transition time period t4~t5, which is shorter than third sub-transition time period t3~t4, selecting signal generator 410 generates selecting signal S5 to turn ON switch 435*e* so that node 425*e* with node voltage Vt4, which is smaller than Vt3, is coupled to drive buffer 440. As a result, drive buffer 440 outputs driving voltage Vt4 which is sufficient to drive an output load, i.e., one of the pixels, during the fourth sub-transition time period. After the fourth sub-transition time period, selecting signal generator 410 generates selecting signal S6 to turn ON switch 435*f* so that node 425*f* with node voltage Vb, which is smaller than Vt4, is coupled to drive buffer 440. As a result, drive buffer 440 outputs driving voltage Vb which is sufficient to drive an output load, i.e., one of the pixels, during a time period to display the current video image. In this manner, driving circuit 400 can control the voltage level of driving voltages during transition and the time period of each sub-transition time period. In this embodiment, the driving voltage is changed from Va to Vb according to a quasi-convex curve, which is indicated by a dotted line 600, during transition.

In this embodiment, driving circuit 400 can provide transitional driving voltages with various level change characteristics not only by predetermining the time period of each sub-transition time period, but alternatively or additionally predetermining the resistance of each resistor of the serial-connected resistor string of voltage divider 420. In addition, by predetermining the number of serial-connected resistors of voltage divider 420, which corresponds to the number of sub-transition voltages, a desired level of accuracy for the control of sub-transition driving voltages by driving circuit 400 can be achieved. More specifically, as the number of resistors in voltage divider 420 is increased, the number of node voltages is increased, so that a desired transitional voltage characteristic can be more accurately achieved.

Voltage divider 420 of driving circuit 400 disclosed in the above embodiment includes a serial-connected resistor string to provide a plurality of sub-transition voltages. However, the invention is not so limited. For example, voltage divider 420 can be implemented as a digital circuit including MOS transistors to provide a plurality of sub-transition voltages. In this condition, the driving circuit of the embodiment is a pure digital circuit. By controlling the operation of the driving circuit of the embodiment digitally, the driving circuit can control the length of the transition time period and the levels of the driving voltages during transition more accurately and thus adaptable to a wide range of applications.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

We claim:

1. A driving circuit for providing transition controlled voltage driving of image data levels of a display panel including a plurality of pixels, comprising:

a selecting signal generator to generate a plurality of selecting signals through a plurality of channels according to a first and a second pixel data corresponding to previous and current images, respectively, at timing intervals during the transition for driving pixel data voltage from previous to current levels, wherein each of the plurality of selecting signals is carried by one of the plurality of channels and the plurality of selecting signals are generated serially through each of the plurality of channels;

a voltage divider, coupled across data voltage levels corresponding to said first and second pixel data, to provide a plurality of sub-transition voltages between said data voltage levels by divider steps;

a voltage selector coupled to receive the plurality of sub-transition voltages and the selecting signals, and to selectively output at least a portion of the plurality of sub-transition voltages serially according to the selecting signals; and a drive buffer coupled to receive the outputted sub-transition voltages serially and to serially generate a plurality of sub-transition driving voltages according to the outputted sub-transition voltages at a plurality of interval times during a transition time period, wherein the driving pixel data voltage from said first data voltage corresponding to said first pixel data, to said second data voltage corresponding to said second pixel data, follow said divider steps at the plurality of interval times governed by said sub-transition voltages and said selecting signals.

2. The driving circuit of claim 1, wherein the voltage divider includes a plurality of serial-connected resistors and a plurality of nodes respectively between adjacent ones of the serial-connected resistors.

3. The driving circuit of claim 2, wherein the voltage selector includes a plurality of switches respectively coupled to the nodes and responsive to each of the selecting signals to selectively couple one of the nodes to the drive buffer.

4. The driving circuit of claim 3, wherein only one of the switches is turned ON by the selecting signal while the other switches are turned OFF.

5. The driving circuit of claim 1, wherein the selecting signal generator has controllability of said timing intervals and the voltage divider has controllability of divider steps.

6. The driving circuit of claim 1, wherein the drive buffer serially generates the sub-transition driving voltages after generating a first driving voltage corresponding to the first pixel data and before generating a second driving voltage corresponding to the second pixel data.

7. The driving circuit of claim 1, wherein the voltage selector outputs one of the sub-transition voltages during a sub-transition time period according to one of the selecting signals and the drive buffer generates one of the sub-transition driving voltages according to the one of the sub-transition voltages during the sub-transition time period.

8. The driving circuit of claim 1, wherein the output load is one pixel or several pixels.

9. A method for providing transition controlled driving of image data levels of a display panel including a plurality of pixels, comprising:

receiving a first and a second pixel data corresponding to previous and current images, respectively, at a pixel driving circuit;

generating a plurality of selecting signals serially through a plurality of channels according to the first and the second pixel data, at timing intervals during a transition for driving pixel data voltage from previous to current levels, wherein each of the plurality of selecting signals is carried by one of the plurality of channels and the plurality of selecting signals are generated serially through each of the plurality of channels;

generating a plurality of sub-transition voltages divided from data voltages corresponding to the first and the second pixel data by divider steps;

selectively outputting at least a portion of the plurality of sub-transition voltages in response to the serially generated selecting signals; and driving a pixel voltage according to the outputted sub-transition voltages serially at a plurality of interval times during a transition time period from a first voltage corresponding to said first pixel data, to a second voltage corresponding to said second pixel data, following divider steps at the plurality of interval times, as governed by said sub-transition voltages and said selecting signals.

10. The method of claim 9, wherein the sub-transition driving voltages are generated after generating a first driving voltage corresponding to the first pixel data and before generating a second driving voltage corresponding to the second pixel data.

11. The method of claim 9, wherein one of the sub-transition voltages is generated during a sub-transition time period according to one of the selecting signals and one of the sub-transition driving voltages is generated according to the one of the sub-transition voltages during the sub-transition time period.

12. The method of claim 9, wherein the output load is one or more of the pixels in a display panel.

* * * * *